United States Patent [19]

Glick

[11] Patent Number: 4,616,451

[45] Date of Patent: Oct. 14, 1986

[54] TELESCOPING ROOF STRUCTURE

[76] Inventor: Sidney E. Glick, 15 Lafayette La., Cherry Hill, N.J. 08034

[21] Appl. No.: 740,258

[22] Filed: Jun. 3, 1985

[51] Int. Cl.[4] ..... E04B 1/346

[52] U.S. Cl. ..... 52/66; 52/72; 49/125

[58] Field of Search ..... 52/66, 72, 7, 9, 10; 49/125

[56] References Cited

U.S. PATENT DOCUMENTS

| | | | |
|---|---|---|---|
| 782,534 | 2/1905 | Adams | 49/125 |
| 4,073,098 | 2/1978 | Baker | 52/66 |

FOREIGN PATENT DOCUMENTS

| | | | |
|---|---|---|---|
| 2314371 | 9/1974 | Fed. Rep. of Germany | 52/66 |
| 2445838 | 4/1976 | Fed. Rep. of Germany | 52/66 |
| 2642802 | 3/1978 | Fed. Rep. of Germany | 52/72 |
| 2812245 | 10/1979 | Fed. Rep. of Germany | 52/66 |
| 320475 | 2/1970 | Sweden | 52/66 |
| 613249 | 9/1979 | Switzerland | 52/66 |

*Primary Examiner*—Henry E. Raduazo
*Attorney, Agent, or Firm*—Norman E. Lehrer

[57] ABSTRACT

A movable roof structure for a patio, building, swimming pool or the like is comprised of a plurality of roofing units which are in an overlapping shingle-like arrangement. The roofing units are telescopically movable with respect to each other between a closed position where they partially overlap each other and an open position where they are substantially stacked one on top of the other. Each roofing unit includes a pair of end extrusions and an elongated intermediate extrusion. Each extrusion carries roof panels on the side edges thereof so that said panels are joined end to end in the direction of the width of the roof. The extrusions also carry wheel and track members which cooperate with the extrusion immediately above and below so that the roofing units are movable. A power driven chain or the like moves the roofing units between their closed and open positions.

12 Claims, 10 Drawing Figures

TELESCOPING ROOF STRUCTURE

BACKGROUND OF THE INVENTION

The present invention is directed toward a movable roof structure and more particularly toward a telescoping movable roof structure for a patio, swimming pool, building or the like.

Numerous types of facilities such as swimming pools, tennis courts and patios are frequently used in the open air during fair weather. During inclement weather, however, it would be desirable to provide such facilities with a cover or roof. In order to fulfill both desires, roofs have been proposed in the past which are collapsible or movable so that a closed top can be provided if desired or the same can be opened. Such movable roofs are also sometimes desirable with various other types of buildings.

The proposed prior art movable roof structures known to Applicant are not believed to have been satisfactory. They have either been too complex and, therefore, too difficult and expensive to construct or have been capable of opening only a small portion of the roof.

For example, while the structures shown in U.S. Pat. Nos. 3,566,555; 3,589,084 and 4,073,098 are not very complex, they provide for the movement of only a single panel member or section and accordingly only a portion of the roof can be opened. The structure shown in U.S. Pat. No. 4,283,889 is capable of opening the entire roof but only because the roof is relatively small as only one roof panel is also moved in this structure. U.S. Pat. Nos. 1,006,374 and 2,094,801 show movable roof structures comprised of a plurality of panels which are adapted to telescope with respect to each other so that a larger portion of the roof can be opened. This is a similar concept to Applicant's invention. However, the structure shown in these two latter patents can be used only on a particular predetermined structure. They can be adapted to other structures only by making changes to the roof system itself or the supporting structure or both. This, of course, increases the cost of the roofing system since each must be specially designed.

SUMMARY OF THE INVENTION

The present invention is capable of substantially opening the entire roof and also reduces the cost of movable roofs since the operative components of the invention can be prefabricated in standard sizes and are easily adaptable to substantially any support structure. The telescoping movable roof structure of the present invention is comprised of a plurality of roofing units which are in an overlapping shinglelike arrangement. The roofing units are telescopically movable with respect to each other between a closed position where they partially overlap each other and an open position where they are substantially stacked one on top of the other. Each roofing unit includes a pair of end extrusions and an elongated intermediate extrusion. Each extrusion carries roof panels on the side edges thereof so that said panels are joined end to end in the direction of the width of the roof. The extrusions also carry wheel and track members which cooperate with the extrusion immediately above and below so that the roofing units are movable. A power driven chain or the like moves the roofing units between their closed and open positions.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
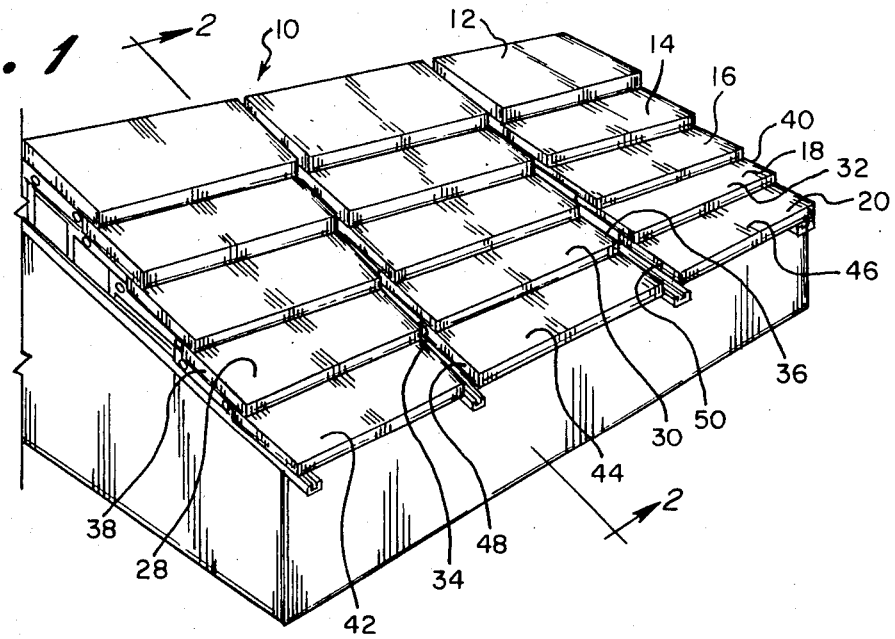
FIG. 1 is a perspective view of a telescoping roof structure constructed in accordance with the principles of the present invention and showing the roof in its closed position.
Figure 2:
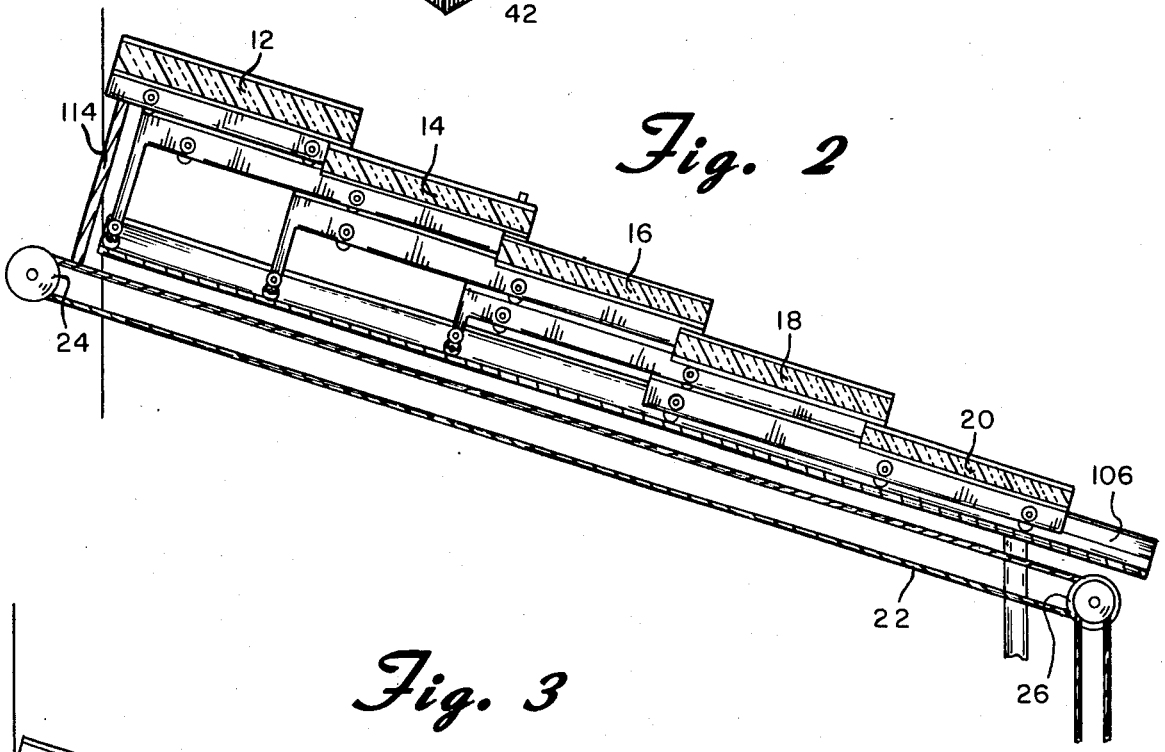
FIG. 2 is a cross-sectional view taken through the line 2—2 of FIG. 1.
Figure 3:
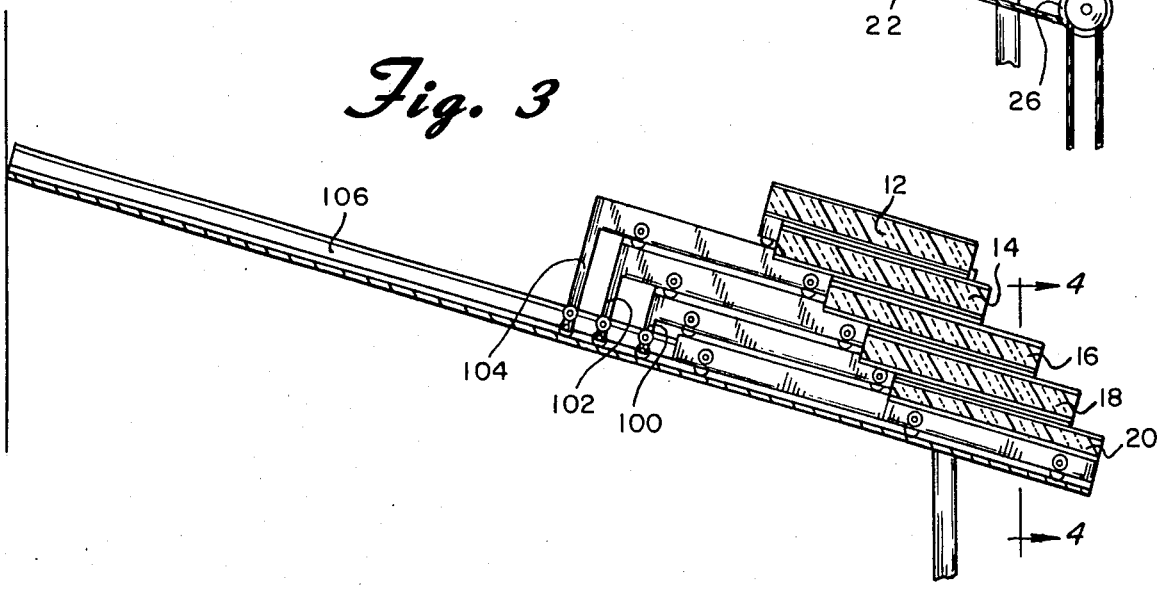
FIG. 3 is a view similar to FIG. 2 but showing the roof structure in its open position.

Referring now to the drawings in detail wherein like reference numerals have been used throughout the various figures to designate like elements, there is shown in FIG. 1 a perspective view of a telescoping roof structure constructed in accordance with the principles of the present invention and designated generally as 10. Roof 10 is comprised of a plurality of roofing units 12, 14, 16, 18 and 20. While five such roofing units are shown in the application, it should be noted that this is by way of example only, any number of units could be used depending on the dimensions of the roof or area being covered. The roofing units are movable between a closed position as shown in FIG. 2 wherein the lower edge of each roofing unit overlies the upper edge of the roofing unit immediately below it on the incline and an open position as shown in FIG. 3 wherein the roofing units are stacked substantially one on top of the other. Movement is provided by a driven chain 22 which extends through the height of the roof and passes around sprockets or pulleys 24 and 26. The driving means is substantially identical to a standard electric garage door opener.

Each of the roofing units is comprised essentially of two major components: a plurality of roofing panels and a plurality of extrusion members which not only support and carry the roofing panels but also provide a means for allowing the roofing units to be telescopically movable. In the embodiment of the invention shown in FIG. 1, each of the roofing units includes three roofing panels, a pair of intermediate extrusion members and an end extrusion member at each remote side edge of the unit. For illustration purposes, the roofing panels of unit 18 have been identified as 28, 30 and 32; the intermediate extrusion members as elements 34 and 36 and the end extrusion members as elements 38 and 40. Similarly, the roofing panels of the lowermost roofing unit 20 have been identified as elements 42, 44 and 46 and the intermediate extrusion members of roofing unit 20 are identified as elements 48 and 50. The foregoing is, of course, by way of example only as a system could be built having a greater number or a smaller number of roofing units and a greater number or smaller number of roofing panels within each unit.

Each of the intermediate extrusion members has an upper portion and a lower portion. The upper portions of all of the intermediate extrusion members are substantially identical to each other. It should be understood, therefore, that the following description of one of the intermediate extrusion members applies equally to all of the other members. While not specifically described, any elements identified by prime reference numerals will be understood to be substantially identical to the element being described.

As shown most clearly in FIGS. 5–9, each of the upper portions of the intermediate extrusion members is elongated in shape and is substantially box-shaped in cross section. It includes a lower wall 52, side walls 54 and 56 and partial top walls 58 and 60. An elongated opening 62 remains between the ends of the partial top walls 58 and 60.

Figure 4:
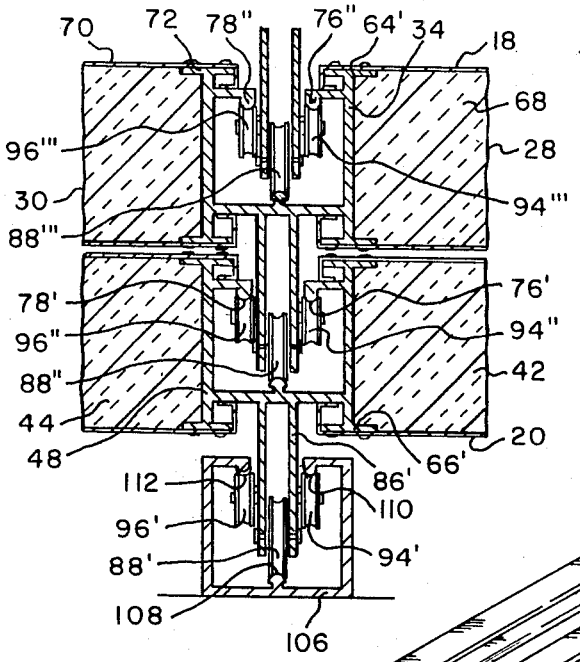
FIG. 4 is a cross-sectional view taken through the line 4—4 of FIG. 3.

The side walls 54 and 56 include flanges 64 and 66 at the top and bottom thereof. As shown in FIG. 4, the purpose of these flanges is to allow for attachment of the roofing panels thereto. A pair of roofing panels are secured to each of the intermediate extrusion members so that the panels are in a substantially end to end relationship. Each panel may be comprised of wood, composite board, plastic or any other suitable material such as shown at 68 and is preferably covered by a thin sheet metal or plastic skin 70 or the like. The skin 70 is used to secure the panels to the flanges 64 and 66 of the side walls 54 and 56 through the use of a plurality of rivets or screws or the like 72.

Carried on the bottom wall 52 of the extrusion member and running the length thereof is a bottom track 74. Bottom track 74 faces upwardly and lies directly under the opening 62. Each of the partial upper walls 58 and 60 also carry a track 76 and 78, respectively. Top tracks 76 and 78 also run substantially the length of the extrusion and face downwardly. The side wall 56 carries an inwardly extending tab 80 which functions as a stop member. As shown most clearly in FIGS. 8 and 9, a portion of the partial upper wall 58 is cut out as shown at 82 to function as part of a detent member which will be described more fully hereinafter.

The lower portion of each extrusion member includes a pair of downwardly extending and spaced apart walls 84 and 86. A pair of wheels 88 and 90 are carried by and between the walls 84 and 86 through axles 92 and 94, respectively, passing through apertures in the walls.

Figure 10:
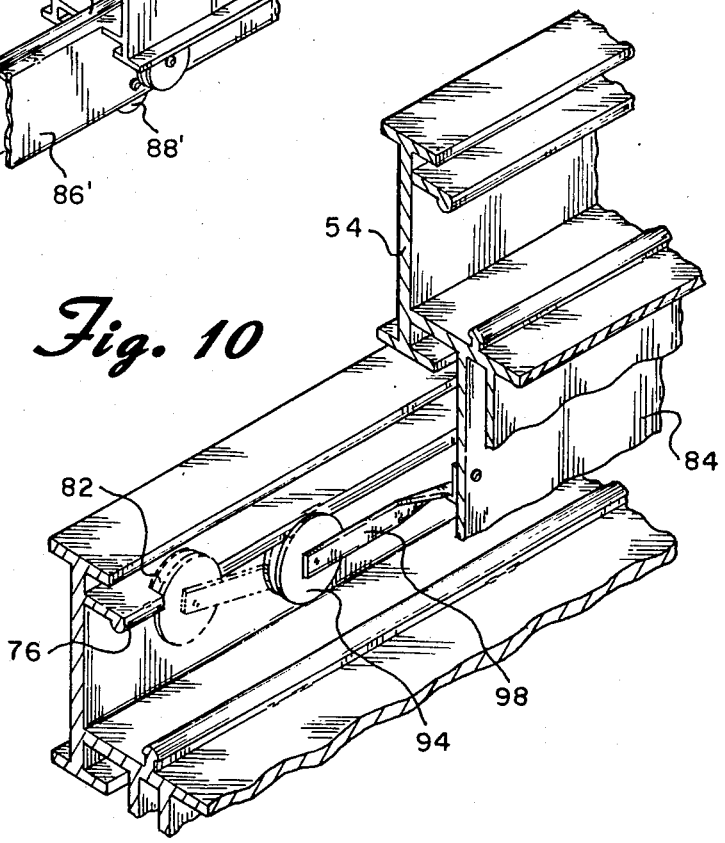
FIG. 10 is a perspective view of a part of a pair of cooperating extrusion members showing a locking detent feature thereof.

Mounted on the outside of walls 84 and 86 are pairs of wheels 94 and 96. There may be two or more pairs of such wheels. Wheels 94 and 96 are mounted to the walls 84 and 86 through the use of leaf springs such as shown at 98 in FIG. 10. The wheels 94 and 96 are normally located in a position above the wheels 88 and 90 and are also spring biased upwardly by the leaf spring 98.

Figure 5:
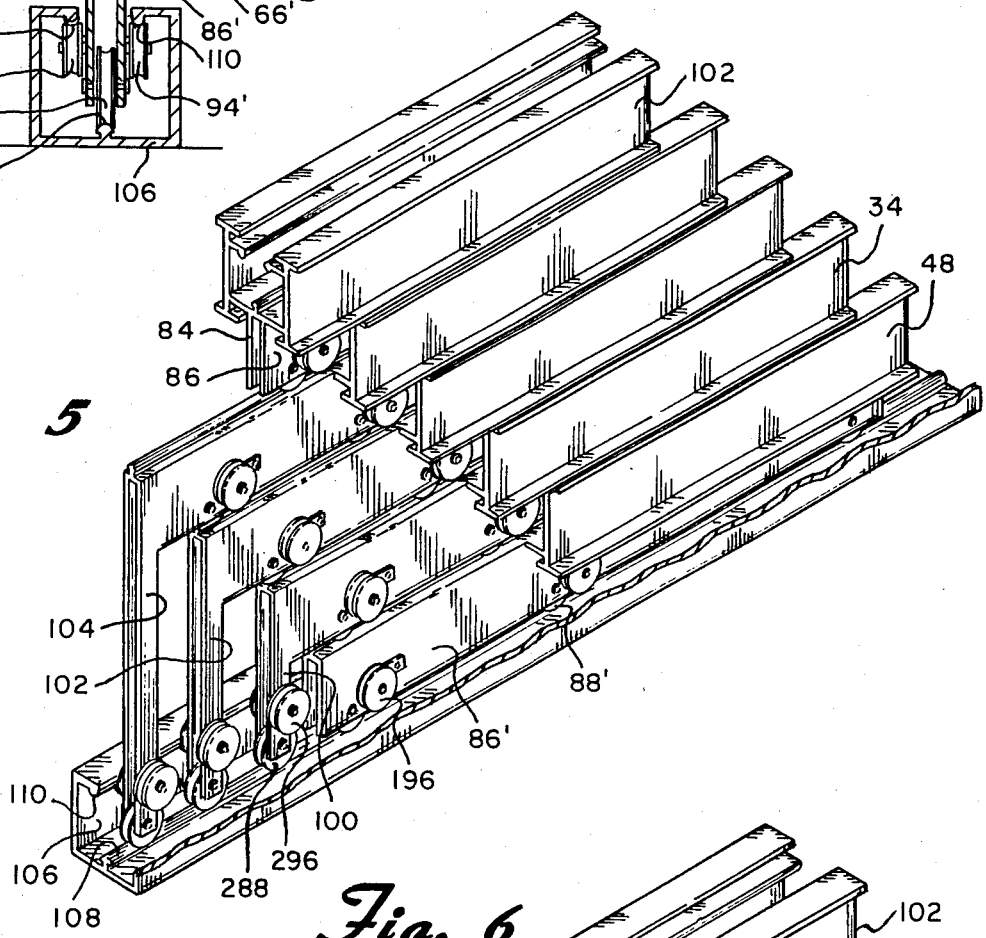
FIG. 5 is a perspective view of a plurality of extrusion members which carry the roof panels and which allow for movement thereof with respect to each other.
Figure 6:
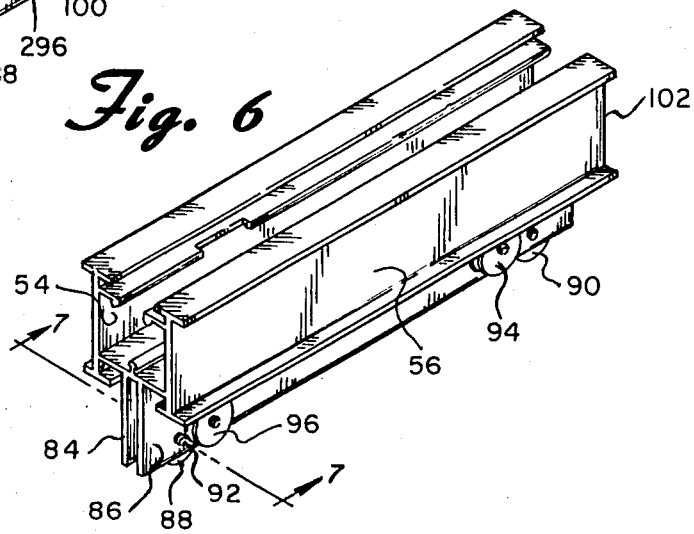
FIG. 6 is a perspective view of the uppermost extrusion member shown in FIG. 5.
Figure 7:
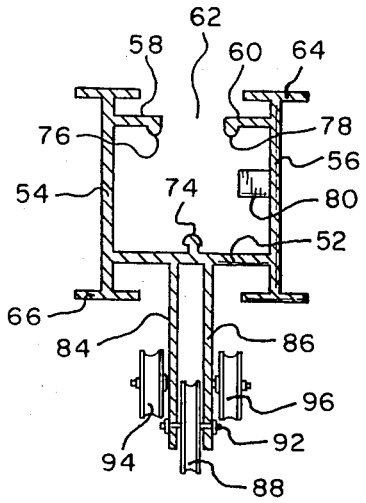
FIG. 7 is a cross-sectional view taken through the line 7—7 of FIG. 6.
Figure 9:
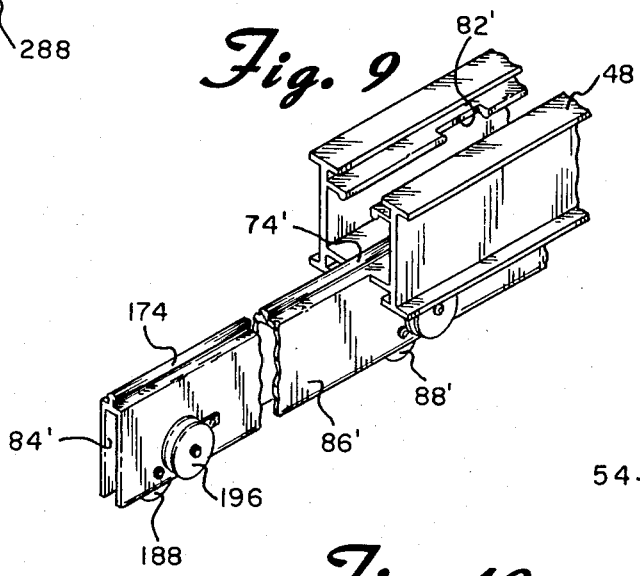
FIG. 9 is a perspective view of the lowermost extrusion member shown in FIG. 5.

The extrusion member 102 shown in FIG. 6 represents the intermediate extrusion member of the uppermost roofing unit 12 and is constructed substantially as described above. As can be seen from FIG. 5, however, the remaining extrusion members include a forward extension of the walls 84 and 86. FIG. 9 represents the lowermost intermediate extrusion member 48 and includes the forward extensions 84' and 84'. A rail or track 174 is located on top of the extensions 84' and 86' and is substantially identical to and a continuation of the bottom track of the extrusion member 48. The extensions 84' and 86' also carry a wheel 188 and a wheel 196 which are mounted in substantially the same manner as the wheels 88 and 96 described above. A second side wheel similar to wheel 94 is also located on the wall of the extension 84' although the same cannot be seen in FIG. 9.

Figure 8:
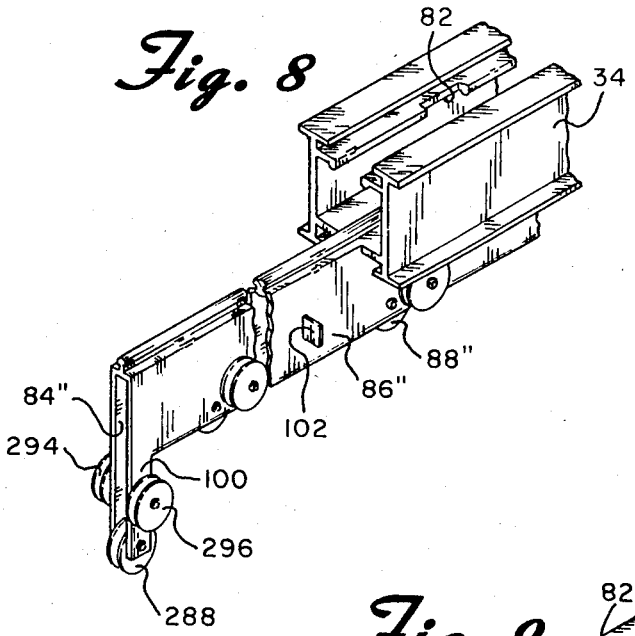
FIG. 8 is a perspective view of one of the intermediate extrusion members shown in FIG. 5.

FIG. 8 illustrates an intermediate extrusion member 34 from the roofing unit 18. This extrusion member 34 is substantially identical to the extrusion member 48 except that it includes a downwardly extending leg 100 at the forward end of the extensions 84'' and 86''. This leg 100 carries wheels 288, 294 and 296 adjacent the lower end thereof which are again substantially identical to wheels 88, 94 and 96 and are mounted in substantially the same manner. Extending outwardly from the side wall of the extension 86'' is a tab 102 which will cooperate with the tabs similar to tab 80 located within the inner wall of the extrusion members to act as a stop means.

As can be seen from FIGS. 2, 3 and 5, there are essentially three types of intermediate extrusion members. Extrusion member 102 shown in FIG. 6 is used in the top roofing unit 12; extrusion member 48 shown in FIG. 9 is used in the bottom roofing unit 20 and the extrusion members utilized in the other roofing units 14, 16 and 18 are similar to the extrusion member 34 shown in FIG. 8. The only difference between these extrusion members is the length of the leg 100. The length of the leg increases going upwardly toward the top of the roof. Thus, it can be seen that leg 104 is longer than leg 102 which is longer than leg 100.

Although the end extrusion members such as 38 and 40 have not been specifically described, these members can be constructed to be substantially identical to the intermediate extrusion members which have been described. Alternately, these end extrusion members can be modified somewhat since only one side edge is being used to support a panel. For example, the flanges 64 and 66 can be removed from one side edge to leave a flat outer wall and to thereby give a neater appearance. In addition, various types of trim or finishing material can be utilized with the end extrusions or the intermediate extrusions for appearance purposes.

The telescoping roof structure of the invention cooperates with the building or other substructure to which it is applied through a track member 106 shown most clearly in FIGS. 4 and 5. A plurality of track members 106 will be employed, one underlying each of the line of extrusion members. The track member 106 may be mounted on a beam or rafter of the building or, if constructed of heavy enough material, may itself function as a beam or rafter. Track member 106 includes a centrally located upwardly facing track 108 and two downwardly facing tracks 110 and 112.

The cooperation between the various extrusion members and the track 106 can best be seen from FIGS. 2–5. From FIG. 4, it can be seen that the lowermost part of extrusion 48 extends downwardly into the track member 106 so that the wheel 88' rides on the track 108. At the same time, wheels 94' and 96' are biased upwardly and ride on tracks 110 and 112. The spring biased mounting of these wheels keeps the various interconnecting members under some tension to prevent unwanted shaking and movement. In a like manner, wheel 88″ from the lower portion of extrusion member 34 rides on the track 74′ located within the extrusion member 48. Likewise, wheels 94″ and 96″ ride on the downwardly facing tracks 76′ and 76″. It should be readily apparent to those skilled in the art that the same cooperation and interconnection between the track and wheel means of the various extrusions are substantially identical throughout.

As stated above, the roofing units are moved by way of the driven chain 22. A rigid bar 114 or the like extends upwardly from the chain 22 to one of the panels of the uppermost roofing unit 12. When the roof is in its closed position as shown in FIG. 2, the roofing units are interlocked with each other by the detent means shown in FIG. 10. The detent means is comprised of at least one of the wheels 94 or 96 from each of the extrusion members entering the opening or cut out portion 82 from the extrusion member below. The wheel 94 is moved upwardly into the opening by the force of the leaf spring 98. The wheels 94 and openings 82 are arranged on each of the extrusion members so that each locks into the member above and below it when the roof is in its totally closed position as shown in FIG. 2.

When it is desired to open the roof, the chain 22 is moved so that rod 114 begins to move downwardly. The downward force will eventually overcome the force of the leaf spring so that the wheel 94 will roll out of the opening 82 and resume its proper position on the track 78. As the uppermost roofing unit 12 moves downwardly and overlies the roofing unit 14, eventually one of the stop members 102 will engage the stop member 80 so that both roofing units 12 and 14 will then be moved in unison. In a like manner, the force of the spring loaded detent means of the extrusion members of roofing unit 14 will eventually be overcome and roofing units 12, 14 and 16 will be moved in unison. This will continue until all of the roofing units are stacked in the position shown in FIG. 3.

To close the roof, the opposite procedure is followed. The chain is moved upwardly and the bar 114 begins to pull the roofing unit 12 upwardly. Eventually the detent means will engage and a second set of stop members 80 and 102 will engage. At this point, the roofing unit 12 will then carry the roofing unit 14 along with it and this procedure will repeat itself until the roof is closed.

It should be readily apparent to those skilled in the art that the various extrusion members function not only to carry the roofing panels but also serve as the wheel and track means allowing for movement. The extrusion members can be prefabricated in standard sizes to cover substantially any size roof. For wider roofs, one merely needs to use wider roof panels or add further extrusion members in each roofing unit. For higher roofs, one need merely add an additional roofing unit. If needed, the stop members 80 and 102 and the openings 82 forming the detent means can be relocated so that the roofing units will be evenly spaced when in the closed position.

The term "extrusion" has been used to refer to the various extrusion members since it is intended that these elements be made by an extrusion process. The extrusion members can be made of aluminum or other light metal or substantially any other suitable material. It is not absolutely necessary that these elements be made by an extrusion process. It is possible within the scope of the present invention that they be made by any process and the term "extrusion member" will apply equally thereto.

The present invention may be embodied in other specific forms without departing from the spirit or essential attributes thereof and accordingly reference should be made to the appended claims rather than to the foregoing specification as indicating the scope of the invention.

I claim:

1. A movable roof structure comprising:

a plurality of roofing units, each of said roofing units being comprised of at least one extrusion member and a pair of roofing panels, one of each of said pair of panels being connected to either side of said extrusion member;

wheel and track means carried by each of said extrusion members and being in cooperative relationship with an adjacent extrusion member of an adjacent roofing unit, each of said track means including means for preventing the wheel means from the next adjacent roofing unit from moving upwardly away from each said track means;

said roofing units being movable in telescoping relationship with respect to each other whereby said roof can be moved between an open position and a closed position and including spring biased detent means for maintaining said roofing units in said open and in said closed positions, and means for moving said roofing units.

2. The invention as claimed in claim 1 wherein said roof structure is inclined to the horizontal.

3. The invention as claimed in claim 2 wherein said extrusion members are inclined parallel to said roof structure.

4. The invention as claimed in claim 3 wherein said roofing units are arranged in overlapping relationship with respect to each other.

5. The invention as claimed in claim 4 wherein the lower edge of each roofing unit overlies the upper edge of the roofing unit immediately below it on the incline when said roof structure is in its closed position.

6. The invention as claimed in claim 5 wherein said roofing units are stacked substantially one on top of the other when said roof structure is in its open position.

7. The invention as claimed in claim 6 further including at least one rafter track means mounted on a rafter of the building supporting the roof structure and wherein the extrusion member of at least all of the roofing units except the top most unit includes a wheel riding on said rafter track means.

8. The invention as claimed in claim 7 wherein at least one of said extrusion members includes a leg downwardly extending toward said rafter track means and wherein the lower portion of said leg carries said wheel.

9. The invention as claimed in claim 8 wherein a plurality of extrusion members includes a downwardly extending leg and wherein the lengths of said legs increase from the roofing unit near the bottom of the roof structure to those near the top thereof.

10. The invention as claimed in claim 9 further including means for preventing said roofing units from moving upwardly away from said rafter track.

11. The invention as claimed in claim 1 wherein each of said roofing units includes a plurality of said extrusion members and at least three panels.

12. The invention as claimed in claim 1 wherein there are at least three of said roofing units.

* * * * *